US006513472B2

(12) United States Patent
Speil et al.

(10) Patent No.: US 6,513,472 B2
(45) Date of Patent: Feb. 4, 2003

(54) VALVE TRAIN OF AN INTERNAL COMBUSTION ENGINE

(75) Inventors: Walter Speil, Ingolstadt (DE); Oliver Schnell, Veitsbronn (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/086,207

(22) Filed: Feb. 28, 2002

(65) Prior Publication Data

US 2002/0121255 A1 Sep. 5, 2002

(30) Foreign Application Priority Data

Mar. 1, 2001 (DE) ..... 101 09 954

(51) Int. Cl.[7] ..... F01L 1/14

(52) U.S. Cl. ..... 123/90.16; 123/90.5; 123/90.55; 123/90.61; 123/198 F

(58) Field of Search ..... 123/90.15, 90.16, 123/90.48, 90.5, 90.55, 90.61, 198 F

(56) References Cited

U.S. PATENT DOCUMENTS

| | | | | |
|---|---|---|---|---|
| 4,704,995 A | | 11/1987 | Soeters | 123/90.5 |
| 5,088,455 A | | 2/1992 | Moretz | 123/90.5 |
| 5,351,662 A | * | 10/1994 | Dopson et al. | 123/90.16 |
| 5,678,514 A | | 10/1997 | Mazzella et al. | 123/90.5 |
| 6,164,255 A | * | 12/2000 | Maas et al. | 123/90.16 |
| 6,196,175 B1 | * | 3/2001 | Church | 123/90.16 |
| 6,314,927 B1 | * | 11/2001 | Schnell | 123/90.16 |
| 6,345,596 B1 | * | 2/2002 | Kuhl | 123/90.16 |
| 6,418,894 B1 | * | 7/2002 | Haas et al. | 123/90.16 |
| 6,427,652 B2 | * | 8/2002 | Faria et al. | 123/90.16 |

FOREIGN PATENT DOCUMENTS

| | | |
|---|---|---|
| DE | 1983334 | 4/1968 |
| DE | 1984827 | 5/1968 |
| DE | 1992038 | 8/1968 |
| DE | 6909964 | 8/1970 |
| DE | 2061602 | 6/1972 |
| DE | 2063819 | 7/1972 |
| DE | 2245666 | 3/1974 |
| DE | 19804952 | 8/1999 |

* cited by examiner

*Primary Examiner*—Weilun Lo
(74) *Attorney, Agent, or Firm*—Bierman, Muserlian and Lucas

(57) ABSTRACT

In a valve train (1) of an internal combustion engine (10), a tappet push rod (2) comprises on its first end (3), a tappet (5) and an uncoupling device (8) made as a single component, and on its second end (4), a hydraulic lash adjuster (15) that acts on a rocker arm. Due to this spatial separation of the lash adjuster (15) from the single component (5, 8), a component (5, 8) is obtained that has a reduced mass and a smaller diameter as well as a relatively simple structure. In addition, the lash adjuster (15) can now be supplied with hydraulic medium directly out of the rocker arm.

9 Claims, 1 Drawing Sheet

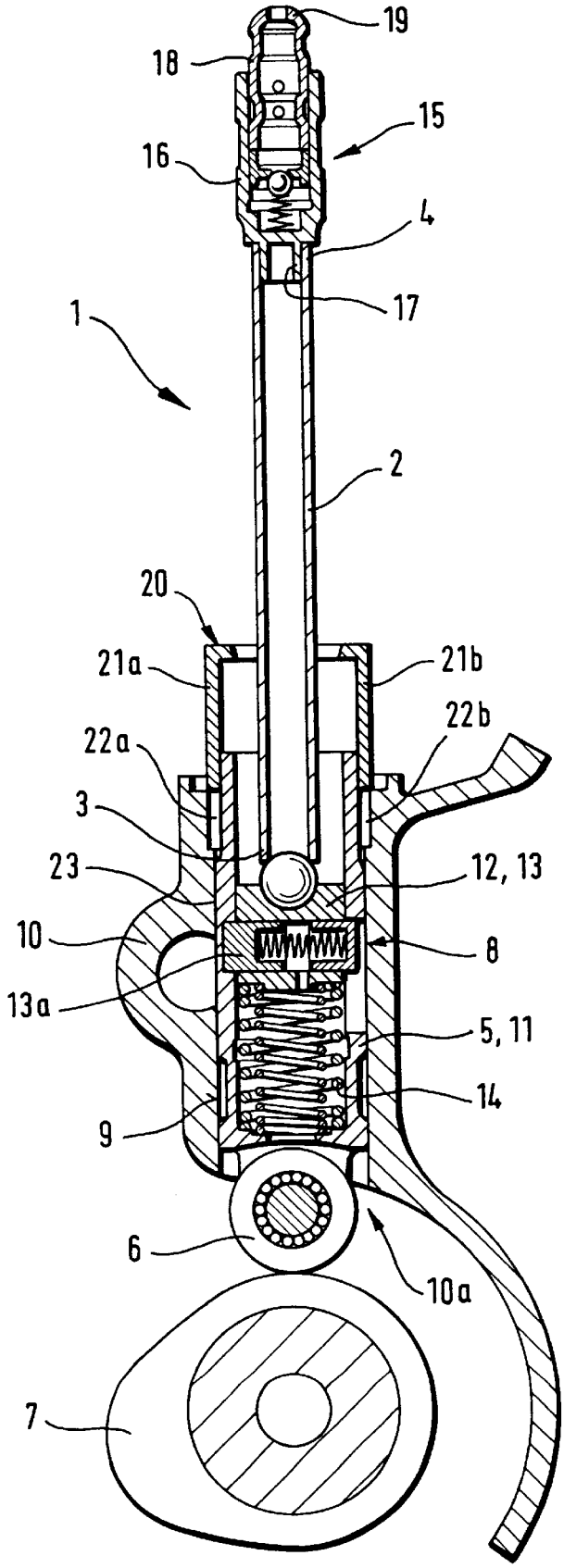
19
18
15
16
4
17
1
2
20
21a
21b
22b
22a
3
23
12, 13
10
8
13a
5, 11
14
9
6
10a
7

VALVE TRAIN OF AN INTERNAL COMBUSTION ENGINE

FIELD OF THE INVENTION

The invention concerns a valve train of an internal combustion engine, said valve train comprising a tappet push rod, a tappet, a hydraulic lash adjuster and an uncoupling device for selectively uncoupling the valve train from a lifting motion of a cam, said tappet push rod comprising on a first end, the tappet and on a second end, a contact surface for activating a rocker arm, which tappet can be loaded by the cam and extends in a reception of the internal combustion engine, the lash adjuster and the uncoupling device being arranged in a region of said first and second ends of the tappet push rod.

BACKGROUND OF THE INVENTION

In a generic valve train of the pre-cited type disclosed in DE 198 44 202, the tappet comprises both the lash adjuster and the uncoupling device. Due to this complex configuration, the tappet has an undesirably large mass. Moreover, the hydraulic lash adjuster has to be supplied with hydraulic medium through the tappet push rod. This relatively long supply path can lead to problems of inadequate supply of hydraulic medium to the lash adjuster, for instance, at a cold start or a re-ignition of the internal combustion engine.

OBJECTS OF THE INVENTION

It is an object of the invention to provide a valve train of the pre-cited type in which the aforesaid drawbacks are eliminated.

This and other objects and advantages of the invention will become obvious from the following detailed description.

SUMMARY OF THE INVENTION

The invention achieves the above objects by the fact that only the tappet and the uncoupling device are configured together as a single component, the lash adjuster is arranged on the second end of the tappet push rod and comprises the contact surface.

This measure leads to a clear reduction of the total mass of the tappet including the uncoupling device compared to prior art devices. At the same time, a tappet is obtained that has only small overall dimensions especially in the direction of its diameter. This arrangement of the hydraulic lash adjuster, which is known per se, on the second end of the tappet push rod, enables the lash adjuster to be supplied directly with hydraulic medium without the otherwise long oil path through the tappet push rod.

It will be clear at this point to a person skilled in the art, that due to its "high" arrangement, the lash adjuster is completely filled with hydraulic medium at a very early point of time after the ignition of the internal combustion engine. Rattling noises and the like are therefore reduced to an extremely low level.

At the same time, due to the spatial separation of the lash adjuster from the coupling device, it is possible to use known types of lash adjusters in place of relatively complex structures that would otherwise be required.

In an advantageous configuration of the single component, it is proposed, for example, to use at least one piston as a coupling element. However, it is also conceivable to use other coupling elements like balls, wedges and other similar components.

A particularly low-friction contact of the cam on the tappet is obtained if the cam contacting surface of the tappet is configured as a roller that may be mounted on a rolling bearing.

Further features of the invention relate to an anti-rotation device of a simple configuration for preventing a rotation of the single component relative to its reception in the internal combustion engine. For this purpose, a rotation-preventing body can extend radially inward from the reception toward the outer peripheral surface of the housing of the single component. A longitudinal groove is arranged opposite this body on said outer peripheral surface. Advantageously, this antirotation device is configured as a guide bridge that is associated to a plurality of components and extends along the internal combustion engine. This bridge can comprise two opposing side walls each of which engages partially into a longitudinal groove of the housing. This guide bridge or strip can also be used as a mounting aid, not specifically represented, for the single component.

A contribution to weight reduction is obtained if the guide bridge is made of a lightweight material such as plastic.

Further propositions of the invention relate to the fixing of the lash adjuster on the second end of the tappet push rod. For example, a housing of the lash adjuster may be fixed on the tappet push rod by a simple positive and/or force-locked connection. More particularly, the housing may comprise a cylindrical extension which is plugged with the outer or inner peripheral surface of the tappet push rod. A pressure piston situated in the housing of the lash adjuster advantageously comprises, directly on its end oriented away from the tappet push rod, the contact surface for the rocker arm.

The valve train of the invention is preferably configured so that it can be completely uncoupled from the cam lift but it is also conceivable to realize partial lifts in the uncoupled state.

The total oscillating mass of the valve train can be reduced particularly when the weight of the tappet push rod is also minimized by making it, for example, as a thin-walled tube or even as a plastic tube or the like.

BRIEF DESCRIPTION OF THE DRAWINGS

The invention will now be described more closely with reference to the appended drawing. The sole FIGURE shows a longitudinal section through a valve train of the invention including a tappet push rod, a tappet and a hydraulic lash adjuster.

DETAILED DESCRIPTION OF THE DRAWING

The FIGURE discloses a valve train 1 of a type that is known in itself in the technical field or is described, for example, in the initially cited prior art document DE 198 44 202 and in the generic prior art referred to in this document.

The valve train 1 comprises a tappet push rod 2 having a first end 3 and a second end 4. In the region of the first end 3, the tappet push rod 2 comprises a tappet 5 that has a contacting surface 6 in the form of a roller for a cam 7. At the same time, an uncoupling device 8 is installed in the tappet 5 so that the tappet 5 and the uncoupling device 8 form a single component (the component 5, 8). The component 5, 8 therefore comprises a cylindrical housing 11 that extends directly in a reception 9 of the internal combustion engine 10 and possesses the contact surface 6 on one side

10*a*. An inner element 12 comprising a support 13 for the tappet push rod 2 extends within the housing 11. One skilled in the art will see in the FIGURE that a piston 13*a* extends within the inner element 12 and, in the state represented in the FIGURE, is partially seated in the housing 11. This means that the FIGURE shows the uncoupling device 8 in its coupled state. A lost motion spring, known per se, that is designated in the present context as a spring element 14 is configured in the form of two inter-inserted compression springs within the housing 11. These springs are supported at one end on the side 10*a* and act at the other end, on a bottom surface of the inner element 12.

As can be seen in the FIGURE, the tappet push rod 2 is configured as a thin-walled tube and this fact has a positive effect on the oscillating mass of the valve train. On its second end, the tappet push rod 2 comprises a hydraulic lash adjuster 15 of a known type. This lash adjuster 15 comprises on the side of its housing 16 nearer the tappet push rod 2, a thin-walled, hollow cylindrical extension 17. This is plugged by its outer peripheral surface with the inner peripheral surface of the tappet push rod 2. If necessary, suitable supplemental fixing measures or fixing measures of a different type may also be used for this purpose.

A pressure piston 18 comprising a contact surface on its free end for activating the rocker arm, not represented in the drawing, extends within the housing 16. Due to this "high" arrangement of the lash adjuster 15 directly under the rocker arm, the path for supplying it with hydraulic medium directly out of the rocker arm is very short. Another advantage is that in most cases, the lash adjuster 15 can be chosen from available standard elements.

At the same time, it is to be remarked that the component 5, 8 of the invention comprising only the tappet and the uncoupling device has a significantly reduced mass and diameter compared to the component described in the initially cited prior art. In addition, the novel component 5, 8 has a relatively simple structure.

A simple anti-rotation device 20 configured as a guide strip is provided in the region of the reception 9 on its side nearer the tappet push rod 2. This device extends along the internal combustion engine and can be used for a plurality of components 5, 8. The anti-rotation device 20 comprises two opposing side walls 21*a*, 21*b* each of which engages with its lower section into a longitudinal groove 22*a*, 22*b* on the outer peripheral surface 23 of the housing 11. This bridge-like anti-rotation device 20 can also be used as a mounting aid for the component 5, 8.

What is claimed is:

1. A valve train of an internal combustion engine, said valve train comprising a tappet push rod, a tappet, a hydraulic lash adjuster and an uncoupling device for selectively uncoupling the valve train from a lifting motion of a cam, said tappet push rod comprising on a first end, the tappet and on a second end, a contact surface for activating a rocker arm, which tappet can be loaded by the cam and extends in a reception of the internal combustion engine, the lash adjuster and the uncoupling device being arranged in a region of said first and second ends of the tappet push rod, characterized in that the tappet and the uncoupling device are configured together as a single component, the lash adjuster is arranged on the second end of the tappet push rod and comprises the contact surface.

2. A valve train of claim 1, wherein the single component comprises an oscillating housing arranged directly in the reception and an inner element telescoped in the housing, said housing comprises on a side directed away from the tappet push rod, a contacting surface for the cam and said inner element comprises a support for the first end of the tappet push rod, in an uncoupled state, at least one piston extends in one of the inner element and the housing, which piston, for achieving coupling, can be displaced in radial or in secant direction partially into the other of the inner element and the housing, and the inner element is biased axially away from the housing by a spring element.

3. A valve train of claim 2, wherein the contacting surface of the housing is made as a rotatable roller.

4. A valve train of claim 2, wherein on a side directed toward the tappet push rod, the housing comprises on an outer peripheral surface, at least one longitudinal groove into which an anti-rotation device extending from the reception engages.

5. A valve train of claim 4, wherein the anti-rotation device is a part of a guide bridge for a plurality of single components, said guide bridge extends with two opposing side walls along the internal combustion engine, and each side wall extends in a longitudinal groove.

6. A valve train of claim 5, wherein the guide bridge is made of a light-weight material.

7. A valve train of claim 6, wherein the light-weight material is a plastic.

8. A valve train of claim 1, wherein the tappet push rod is made as a thin-walled tube at least in the region of the second end, a housing of the lash adjuster is connected to the push rod by at least one of positive engagement and force locking, and a pressure piston extending in the housing of the lash adjuster comprises the contact surface for the rocker arm.

9. A valve train of claim 7, wherein the housing of the lash adjuster is plugged by a cylindrical extension with the tappet push rod.

* * * * *